US005152675A

United States Patent [19]

Morris

[11] Patent Number: 5,152,675

[45] Date of Patent: Oct. 6, 1992

[54] PISTON PUMP WITH ANTI-LEAKAGE CONTROL

[76] Inventor: Billy F. Morris, 941 Shady Grove Rd., Clarkville, Tenn. 37042

[21] Appl. No.: 716,545

[22] Filed: Jun. 17, 1991

[51] Int. Cl.[5] ..... F04B 23/04

[52] U.S. Cl. ..... 417/343; 417/345

[58] Field of Search ..... 417/343, 342, 344, 347, 417/346, 345, 403; 277/212 F, 19

[56] References Cited

U.S. PATENT DOCUMENTS

| | | | |
|---|---|---|---|
| 343,923 | 6/1886 | Schinneller | 277/135 |
| 2,579,568 | 12/1951 | Habenicht | 417/343 X |
| 2,858,767 | 11/1958 | Smith | 417/346 |
| 3,205,906 | 9/1965 | Wilkinson et al. | 417/342 X |
| 4,701,112 | 10/1987 | Eisenhaut | 417/403 |

*Primary Examiner*—Leonard E. Smith
*Attorney, Agent, or Firm*—Rhodes, Coats & Bennett

[57] ABSTRACT

A single acting, piston type pump comprises a pair of cylinders, and a pair of pistons mounted in respective cylinders for reciprocal movement within the cylinders. The pistons are interconnected with one another so that while one piston is moving upward in its cylinder, the opposing piston is moving downward. An inlet line and an outlet line is connected with the active end of each cylinder for drawing fluid into the active chamber when the piston moves upwardly, and expelling fluid through the outlet line when the piston moves downwardly in the cylinder. A cross-over channel is connected between the passive chambers of the cylinders so that the effective volume of the passive chambers remain constant as the pistons reciprocate within the cylinders. Because the volume of the passive chambers remain unchanged, there is less pressure on the seals surrounding the piston rods and a decreased likelihood of leakage.

9 Claims, 1 Drawing Sheet

PISTON PUMP WITH ANTI-LEAKAGE CONTROL

FIELD OF THE INVENTION

The present invention relates generally to fluid actuated piston type pumps, and more particularly to a new construction for a piston type pump to prevent development of leaks around the piston rods.

BACKGROUND OF THE INVENTION

Piston type pumps are well known in the art and typically include a piston mounted in a cylinder for reciprocal movement within the cylinder. The piston is typically mounted on a piston rod which extends through one end of the cylinder. A seal or packing is disposed around the piston rod where it passes through the end of the cylinder to prevent leakage. An inlet is disposed at one end of the cylinder and an outlet is disposed at the opposite end. As the piston moves in one direction, fluid is drawn into the inlet end of the cylinder and is expelled out the outlet by the piston at the opposite end. When the piston reverses direction, the fluid in the inlet end passes through a check valve in the piston into the outlet end of the chamber. Because the piston rod consumes space in the outlet end, a portion of the fluid is expelled through the outlet. The remaining portion is expelled during the next intake-stroke.

During operation, there is a relatively high pressure on the seal surrounding the piston rod. Eventually, the high pressure will result in failure of the seal and the fluid being pumped leaks out around the piston rod.

One solution which has been tried is to provide a double packing at the end through which the rod passes to form a closed chamber to trap any liquid leaking around the piston rod. A drain passage leads from the closed chamber back to the fluid passage. One such system is disclosed in U.S. Pat. No. 2,147,352. A similar arrangement is also shown in U.S. Pat. No. 3,293,994 which incorporates a "trap chamber" in a double-acting hydraulic cylinder for trapping any fluid which leaks around the piston rod.

SUMMARY AND OBJECTS OF THE INVENTION

The present invention is a single-acting, piston-type pump which is particularly designed to prevent development of leaks at or around the piston rod. The pump includes a pair of cylinders, each having a piston mounted therein for reciprocal movement within respective cylinders. The pistons are mounted on piston rods which extend through the passive end of the cylinder. The pistons are interconnected so that they reciprocate out of phase with one another. In other words, one piston reciprocates through an intake stroke while the opposite piston reciprocates through its power stroke. An inlet line and an outlet line communicate with the active end of the cylinders. During the intake stroke, fluid is drawn into the active chamber of the cylinder through the intake line. During the power stroke, the fluid is expelled from the active chamber of the cylinder through the outlet line.

Some of the fluid being pumped will inevitably leak past the piston into the passive end of the cylinder. To overcome the problems caused by fluid accumulation in the passive end of the cylinder, the present invention incorporates a cross-over channel which establishes a fluid communication between the passive ends of both cylinders. Thus, the passive end of the cylinders form one continuous volume whose size does not change during the operation of the pump. The cross-over channel thus avoids excessive pressure which causes the seal around the piston rod to leak, and the adverse consequences or numerous pressure cycles.

It is therefore an object of the present invention to provide a single acting, piston type pump in which the adverse effect of fluid accumulation in the passive end of the cylinder is eliminated.

It is a further object of the invention to provide a single acting, piston-type pump in which excessive pressure in the passive end of the cylinder is avoided so that rod seal failure is eliminated.

Another object of the present invention is to provide a single acting, piston-type pump which avoids constantly repeating cycles with periods of positive and negative pressures.

Another object of the present invention is to provide a single acting, piston-type pump in which fluid accumulating in the passive end of the cylinders is recycled back to the active end of the cylinder.

Other objects and advantages of the present invention will become apparent and obvious from a study of the following description and the accompanying drawings which are merely illustrative of such invention.

DETAILED DESCRIPTION OF THE INVENTION

Figure 1:
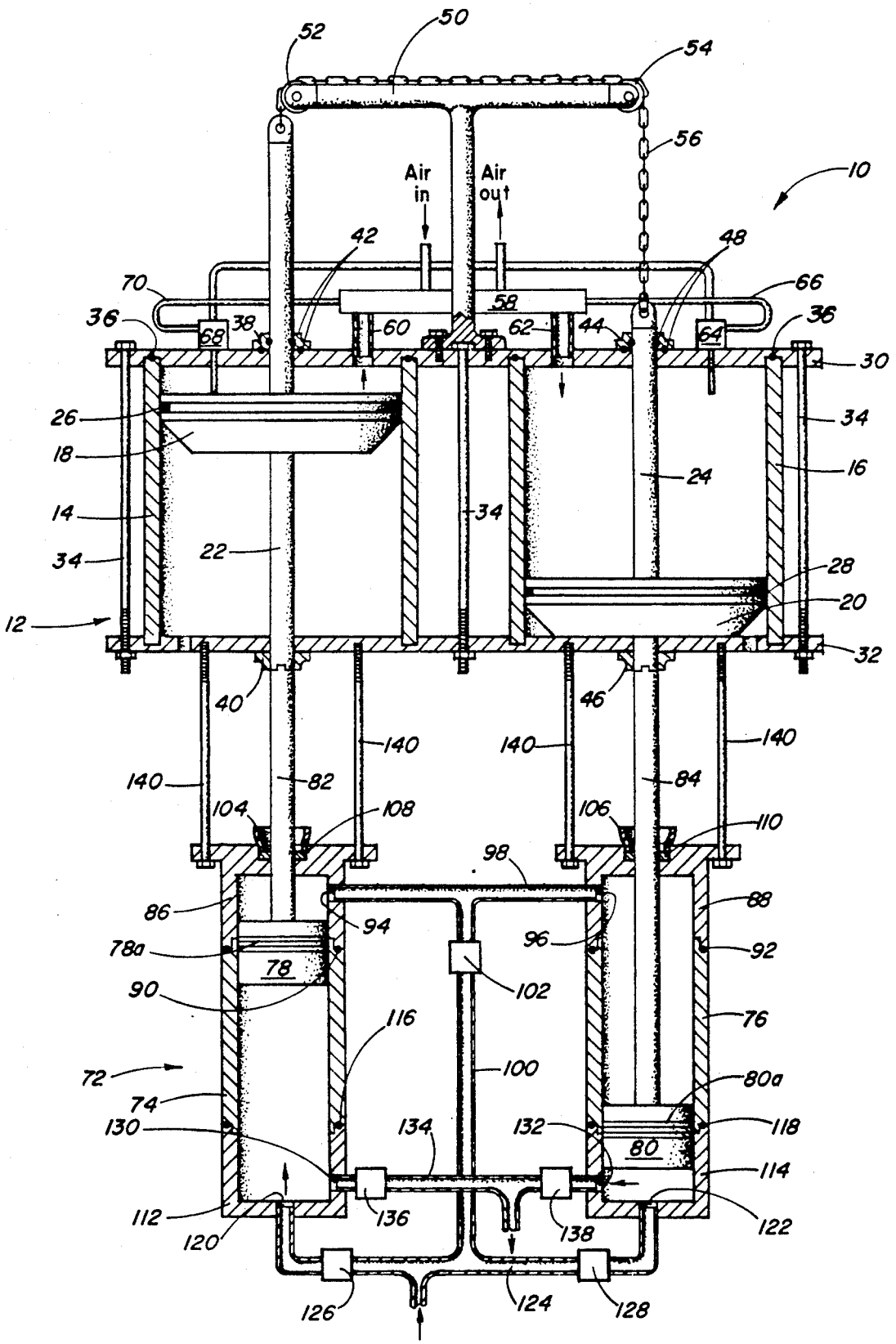
FIG. 1 is a section view of the single acting, piston-type pump of the present invention.

Referring to the drawing, and in particular to FIG. 1, the pneumatic, piston type pump of the present invention is shown therein and indicated generally by the numeral 10. The pump 10 includes a drive assembly indicated generally at 12 and a pump assembly indicated generally at 72.

The drive assembly 12 includes a pair of drive cylinders 14 and 16 which contain pistons 18 and 20 respectively. The pistons 18 and 20 are mounted on piston rods 22 and 24 for reciprocal movement within the cylinders 14 and 16. 0-rings 26 and 28 provide an airtight seal between the pistons 18 and 20 and the walls of the cylinders 14 and 16.

The cylinders 14 and 16 are mounted between two plates 30 and 32. The plates 30 and 32 are held together by tie rods 34. Seals 36 are disposed in grooves in the ends of the cylinders 14 and 16 to provide an airtight seal between the cylinders 14 and 16 and the plate 30. The lower plate 32 includes vent passages to allow free movement of air into and out of the cylinder.

Slide bearings 38 and 40 are mounted on the upper and lower plates 30 and 32 respectively and surround the piston rod 22. The slide bearing 38 includes seals 42 to prevent escape of air around the piston rod 22. A second pair of slide bearings 44 and 46 are mounted on the upper and lower plates 30 and 32 respectively which surround the piston rod 24. Slide bearing 44 includes seals 48 to prevent escape of air around the piston rod 24.

The pistons 18 and 20 within the respective cylinder 14 and 16 are mechanically linked so that when one piston is driven through its power stroke, as herein after described, the opposite cylinder will be pulled through its return stroke. More particularly, a support bar 50 is mounted to the upper plate 30. The support bar 50 includes a pair of sprockets 52 and 54 secured at opposite ends of the support bar 50. A chain 56 is entrained around the sprockets 52 and 54. The chain 56 is attached at one end to the piston rod 22 and to the piston rod 24 at the opposite end. Thus, when piston 18 is driven through its power stroke, the chain 56 will pull the opposite piston 20 through its return stroke.

The pistons 18 and 20 are driven through the power stroke by a pressurized gas, such as compressed air. An automatic reciprocating spool valve 58 alternately directs the pressurized gas through lines 60 and 62 into cylinders 14 and 16. When the spool valve 58 is in one position, air is directed into cylinder 14 forcing piston 18 downwardly. As piston 18 moves downwardly, piston 20 is pulled upwardly in cylinder 16. The air in cylinder 20 is forced out through line 62 and spool valve 58. When piston 18 reaches the top of its return stroke, poppet valve 64 is actuated so that pressurized gas is directed through line 66 to the spool valve 58 causing the spool (not shown) to shift. After shifting, the spool valve 58 directs the pressurized gas through line 62 forcing piston 20 downwardly while piston 18 is pulled through its return stroke. When piston 18 reaches the top of its return stroke, poppet valve 68 is actuated directing pressurized gas through line 70 to the spool valve 58 causing the spool to shift back. This cycle is repeated continuously as long as the pump 10 is operating. Since spool valve 58 of this type are well-known in the art, further discussion is omitted.

The drive assembly 12 drives the pump assembly 72 which is mounted below the drive assembly 12. The pump assembly 72 includes two pump cylinders 74 and 76 which contain reciprocating pistons 78 and 80 mounted on piston rods 82 and 84. The piston rods 82 and 84 are threadably engaged with the piston rods 22 and 24 of the drive assembly 12.

The upper end of the cylinders 74 and 76 are enclosed by upper cylinder heads 86 and 88 which are threadably engaged with the cylinders 74 and 76. 0-rings 90 and 92 provide a seal between the upper cylinder heads 86 and 88 and the cylinders 74 and 76. The cylinder heads 86 and 88 each conclude an outlet port indicated respectfully at 94 and 96. The outlet ports 94 and 96 are connected together by a cross-over line 98. Line 100 connects the cross-over line 98 to the inlet line and includes a one-way valve 102 to prevent flow of fluid from the inlet line into the cross-over line 98. The relief valve 102 is set to provide a pressure of approximately 25 psi within the passive end of the cylinders 74 and 76. The upper cylinder heads 86 and 88 also include oil cups 104 and 106 which are numbered 104 and 106 respectively which contain lubricant which keeps the piston rods 82 and 84 lubricated. Rod seals 108 and 110 ar mounted beneath the oil cups 104 and 106 to provide an airtight seal around the piston rods 82 and 84. This small pressure maintained within the cylinders 74 and 76 prevents lubricant from seeping into the cylinders past the rod seals 108 and 110.

The lower end of the cylinders 74 and 76 are enclosed by lower cylinder heads 112 and 114 which are threadably engaged with the cylinders 74 and 76. 0-ring seals 116 and 118 provide a seal between respective heads and cylinders. The lower cylinder heads each include an inlet port indicated at 120 and 122 respectively. The inlet ports 120 and 122 are connected to the inlet line 124. Ball-check valves 126 and 128 prevent the backflow of fluid into the inlet line 124.

The lower cylinder heads 112 and 114 also include exhaust ports 130 and 132. The exhaust ports 130 and 132 are connected to an exhaust line 134. Ball-check valves 136 and 138 prevent the backflow of fluid from the exhaust line 134 into the cylinders 74 and 76.

The pump assembly 72 is mounted to the drive assembly 12 by tie rods 140. At least three tie rods 140 connect each pump cylinder to the lower plate 32 of the drive assembly 12. The upper end of the tie rods are threaded into openings formed in the plate 32.

In operation, the pistons 78 and 80 alternately draw fluid into their respective cylinders 74 and 76 during their return stroke, and push the fluid out through the outlet ports 130 and 132 during their power stroke. If any fluid being pumped leaks past the pistons 78 and 80 into the passive chamber of the cylinder, it will be returned to the active chamber through lines 98, 100 and 124. Excessive pressure in the passive chambers of the cylinders is avoided since the cross-over line 98 establishes fluid communication between the cylinders 74 and 76. As a result, the passive chambers together with the cross-over line 98 define a continuous volume which does not change during operation of the pump. This constant volume also avoids the problems with alternating pressure cycles having alternating periods of negative and positive pressure. Instead, the pressure inside the passive chambers of the cylinders 74 and 76 remains at a relatively low, constant pressure which will significantly increase the life of the rod seal. Further, because there is never a vacuum on the passive end of the cylinder, there is less likelihood of lubricant in the oil cup being suctioned around the piston rod into the passive end of the cylinder which could contaminate the fluid being pumped.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A piston-type pump comprising:

(a) a pair of cylinders;

(b) a pair of pistons mounted in respective cylinders for reciprocal movement within the cylinders, wherein the pistons divide the cylinders into an active chamber and passive chamber;

(c) means for interconnecting the pistons so that the pistons reciprocate out of phase with one another;

(d) an inlet line and outlet line in fluid communication with the active chamber of each cylinder for drawing fluid into the active chamber when the piston moves in a first direction and expelling fluid out of the cylinders when the piston moves in the opposite direction;

(e) a cross-over channel for establishing fluid communication between the passive chambers of the cylinder so as to form a collective volume encompassing both passive chambers, wherein the collective volume of the passive chambers remain constant as the pistons reciprocate within the respective cylinders; and (f) a return line connected between the crossover channel and the inlet line for recycling fluid which leaks past the pistons into the passive chamber.

2. The pump according to claim 1 wherein the means for reciprocating the pistons comprises a second pair of cylinders coaxially disposed with respect to the first cylinders; and second pair of pistons mounted within the second cylinders for reciprocal movement within the second cylinders; a piston rod connecting respective first and second pistons together; and automatic valve means for alternately applying a pressurized gas to the second pistons to drive one on the second pistons through a powered stroke while the other of said second pistons is pulled through a return stroke by the interconnecting means.

3. The pump according to claim 2 wherein the interconnecting means comprises a chain entrained around a pair of sprockets with one end of the chain being secured to a first one of the piston rods and the opposite end of the chain being secured to the other one of said piston rods.

4. A piston-type pump comprising:

(a) a pair of cylinders;

(b) a pair of pistons mounted in respective cylinders for reciprocal movement within the cylinders, wherein the pistons divide the cylinders into an active chamber on one side of the piston and a passive chamber on the opposite side of the piston;

(c) a second pair of cylinders disposed coaxially with respect to the first pair of cylinders;

(d) a second pair of pistons mounted in respective second cylinders for reciprocal movement within the second cylinders;

(e) means for connecting respective pairs of first and second pistons so that the first cylinders reciprocate in phase with a respective second piston;

(f) means for interconnecting the pairs of cylinders so that the pairs reciprocate out-of-phase with one another;

(g) automatic valve means for alternately applying a pressurized gas to the second pistons to reciprocate each pair of pistons within their respective cylinders through alternating intake and power strokes;

(h) fluid intake means connected to a fluid source for supplying a fluid being pumped to the active chambers of the first cylinders during the intake stroke;

(i) fluid outlet means for discharging the fluid being pumped from the active chamber during the power stroke;

(j) a fluid conduit means for establishing communication between the passive chambers of the first cylinders so as to form a single collective volume of the passive chambers remains constant during the operation of the pump; and (k) a return line connected between the crossover channel and the inlet line for recycling fluid which leaks past the pistons into the passive chamber.

5. The piston-type pump according to claim 4 wherein return line includes a one-way, relief valve to prevent fluid from flowing from the inlet means to the passive chambers.

6. The piston-type pump according to claim 5 wherein the relief valve is set to provide a relatively low pressure in the passive end of the cylinders.

7. The piston-type pump according to claim 4 wherein the means for connecting respective pairs of pistons comprises a piston rod.

8. The piston-type pump according to claim 7 wherein the piston rods extends through the passive ends of the first cylinders, and wherein the pump includes seal means for preventing fluid from leaking around the piston rods.

9. The piston-type pump according to claim 8 further including a cup means disposed around the piston rods at the ends of the cylinders for holding a fluid.

* * * * *